United States Patent [19]

Verkasalo

[11] Patent Number: 4,757,582

[45] Date of Patent: Jul. 19, 1988

[54] ROLL WITH HEATED MANTLE AND METHOD

[75] Inventor: Matti Verkasalo, Jyvaskyla, Finland

[73] Assignee: Valmet Oy, Finland

[21] Appl. No.: 12,848

[22] Filed: Feb. 10, 1987

Related U.S. Application Data

[63] Continuation-in-part of Ser. No. 718,099, Apr. 1, 1985, abandoned.

[51] Int. Cl.[4] ..... B30B 3/00; D21F 11/00

[52] U.S. Cl. ..... 29/116.2; 29/124; 29/125; 29/130; 100/155 R; 162/205

[58] Field of Search ..... 29/116 AD, 116 R, 124, 29/122, 121.1, 125, 126, 130; 34/124; 165/89; 162/205, 357; 100/155 R; 219/319

[56] References Cited

U.S. PATENT DOCUMENTS

| | | | |
|---|---|---|---|
| 3,643,344 | 2/1972 | Strube | 34/124 |
| 4,394,793 | 7/1983 | Pav et al. | 29/116 AD |
| 4,476,637 | 10/1984 | Justus et al. | 34/124 |
| 4,498,383 | 2/1985 | Pav et al. | 29/116 AD |
| 4,535,230 | 8/1985 | Brieu | 162/357 |
| 4,542,593 | 9/1985 | Viitanen et al. | 34/124 |
| 4,625,637 | 12/1986 | Pav et al. | 29/116 AD |
| 4,639,990 | 2/1987 | Schiel et al. | 29/116 R |

FOREIGN PATENT DOCUMENTS 2102913 2/1983 United Kingdom .

*Primary Examiner*—Howard N. Goldberg
*Assistant Examiner*—Irene Cuda
*Attorney, Agent, or Firm*—Steinberg & Raskin

[57] ABSTRACT

A method for controlling the transverse thickness profile of paper or other web-like product by controlling temperature, including the axial temperature profile, of the mantle of a roll forming a nip with another roll in the manufacture of the paper or other web-like product includes forming a layer of heat transfer liquid on the inner surface of the mantle under the effect of the centrifugal forces generated by the rotation of the mantle, the layer of heat transfer liquid being divided into separate annular sections, and controlling the temperature of the heat transfer liquid layer of each of the sections. A roll in accordance with the invention includes a cylindrical outer mantle rotatably mounted at its axial ends, a stationary inner shaft situated within the mantle and partitions for dividing a layer of heat transfer liquid formed on the inner surface of the mantle into a plurality of separate annular sections. The temperature of the heat transfer liquid layer of each of the sections is controlled through the circulation of the heat transfer liquid of each section or through the provision of heat transfer elements in respective sections.

37 Claims, 4 Drawing Sheets

ROLL WITH HEATED MANTLE AND METHOD

CROSS-REFERENCE TO RELATED APPLICATIONS

The present application is a continuation-in-part of copending U.S. application Ser. No. 718,099, filed Apr. 1, 1985, now abandoned.

BACKGROUND OF THE INVENTION

The present invention relates to a method for controlling the transverse thickness profile of paper or other web-like product by controlling temperature level and/or the axial temperature profile of the mantle of a roll used in the manufacture of the paper or other web-like product, the roll forming a nip together with a counter-roll through which the paper or web-like product passes.

The invention also relates to a roll such as a calender roll, used in accordance with the method which comprises a cylindrical mantle rotatably journaled at its axial ends and within which a stationary inner shaft is situated.

It is known in the prior art to heat rolls of paper machines such, for example, as calender rolls, by supplying heat transfer liquid, usually water, into the interior of the roll mantle through a connection provided at one end of the shaft of the roll and by removing the heat transfer liquid through a connection provided in the opposite end of the roll shaft. The quantity Q of heat supplied to the roll in this manner can be designated by the following equation:

$$Q=\overline{m}\cdot c\cdot\Delta t=\overline{m}\cdot c\cdot(t_s-t_u)$$

where $\overline{m}$ is the mass flow rate of the heat transfer liquid, c is the specific heat of the heat transfer liquid, $t_s$ is the temperature of the heat transfer liquid at the inlet to the roll and $t_u$ is the temperature of heat transfer liquid at the outlet from the roll. When water is used as the heat transfer liquid, the maximum value of $t_s$ is about 120° C. If $t_s$ is higher than about 120° C., oil is generally used as the heat transfer liquid. However, the specific heat c of oil is less than that of water.

Prior art arrangements of the type described above have several drawbacks. For example, one drawback is that a calender roll which is heated in the conventional manner described above must be dimensioned and constructed as a pressure vessel. From the viewpoint of the heating of a roll obtained by the conventional heating arrangement described above, it is a drawback that one axial end of the roll will be raised to higher temperature than the other end due to the temperature drop of the heat transfer liquid as it travels from the roll inlet to the outlet. Since it is necessary to increase the temperature differential ($t_s-t_u$) to increase the heating efficiency, an increase in efficiency will necessarily be accompanied by greater differences in temperature between the ends of the roll. It is a further drawback of conventional heating arrangements of the type described above that it is not possible using such arrangements to adjust the axial temperature profile of the roll.

Reference is also made to the publication OE-OS 29 02 955 of Escher Wyss AG of Switzerland which discloses apparatus for heating a variable-crown roll. In particular, a roll is disclosed in which nozzles are fitted in the space provided between an inner stationary shaft and an outer rotary mantle of the roll. Jets of heat transfer liquid are directed through the nozzles of the roll mantle for heating the same.

SUMMARY OF THE INVENTION

Accordingly, it is an object of the present invention to provide new and improved methods and apparatus for controlling the transverse thickness profile of a web such as a paper web.

It is also an object of the present invention to control the web thickness profile by controlling the axial profile of the diameter of a mantle of a roll forming a nip with another roll, through which the web passes.

It is another object of the present invention to provide new and improved methods and apparatus for controlling the temperature of the mantle of the roll forming the nip with the other roll used in the manufacture of paper or other web-like products.

Another object of the present invention is to provide new and improved methods and apparatus for controlling the axial temperature profile of a roll mantle.

Still another object of the present invention is to provide new and improved methods and apparatus for controlling the temperature and axial temperature profile of a roll used in the manufacture of paper or other web-like products and which eliminate the drawbacks described above.

A further object of the present invention is to provide a new and improved roll for use in the manufacture of paper and other web-like products whose temperature and axial temperature profile can be precisely adjusted.

Briefly, in accordance with the present invention, these and other objects are attained by a method of controlling the transverse thickness profile of a web in the continuous manufacture thereof, the web passing through a nip formed by two rolls such as a calender nip, comprising the steps of forming a layer of heat transfer liquid of appropriate thickness on the inner surface of the mantle of at least one of the rolls during its rotation, the heat transfer liquid layer being divided into axially adjacent annular sections which are separated from each other, and controlling the temperature of the heat transfer liquid layer of each of the sections independently from the other sections. The heat transfer liquid layer is formed by the effect of the centrifugal forces which are generated by the rotation of the roll mantle.

The individual control of temperature of the liquid of each discrete annular section in turn influences the extent of thermal expansion of the axial region of the roll mantle adjacent thereto, thus determining the diameter of the corresponding axial regions of the roll mantle, and thereby of the entire roll. This results in a controlled variation of roll diameter over the axial length thereof, which, in turn, controls the axial pressure profile applied in the nip between the two rolls. The transverse thickness profile of the web passing through the nip is thereby determined.

The objects of the invention are also attained by providing a roll, such as a calender roll forming a nip with a counter roll, including a cylindrical outer mantle rotatably mounted at its axial ends, a stationary inner shaft situated within the mantle, means for forming a layer of heat transfer liquid on the inner surface of the mantle by which heat can be transferred to the roll mantle, partition means for dividing the liquid layer into a plurality of separate annular sections in the axial direction of the roll mantle, the annular sections preferably being uniformly spaced, and means for controlling the temperature of the heat transfer liquid layer of each of the sections independently from the other sections.

The liquid temperature controlling means, in turn, influences the extent of the thermal expansion and therefore the diameter of the axial regions of the mantle corresponding to the respective annular sections. The axial profile of the roll diameter is thereby variably controlled over the axial length of the roll, in turn controlling the axial pressure profile applied in the nip. Thus the transverse thickness profile of the web is controlled.

According to one embodiment, the temperature of the heat transfer liquid layer of each section is controlled through the circulation of the heat transfer liquid of each respective section. A separate circulating system is provided for each heat transfer liquid layer section whereby the heat transfer liquid is withdrawn, such as by means of a stationary catcher, whereupon the temperature of the heat transfer liquid is adjusted by a control system. The heat transfer liquid of the desired adjusted temperature is then passed back into respective heat transfer liquid sections.

According to another embodiment, the temperature of the heat transfer liquid layer of each section is controlled by means of stationary heating elements, such as electric resistance elements, situated at each respective heat transfer liquid section. According to this embodiment, the liquid layer functions exclusively as a heat transfer medium and is circulated only to a very limited extent for the purpose of maintaining the quantity of liquid in each respective heat transfer liquid layer section substantially constant.

DETAILED DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
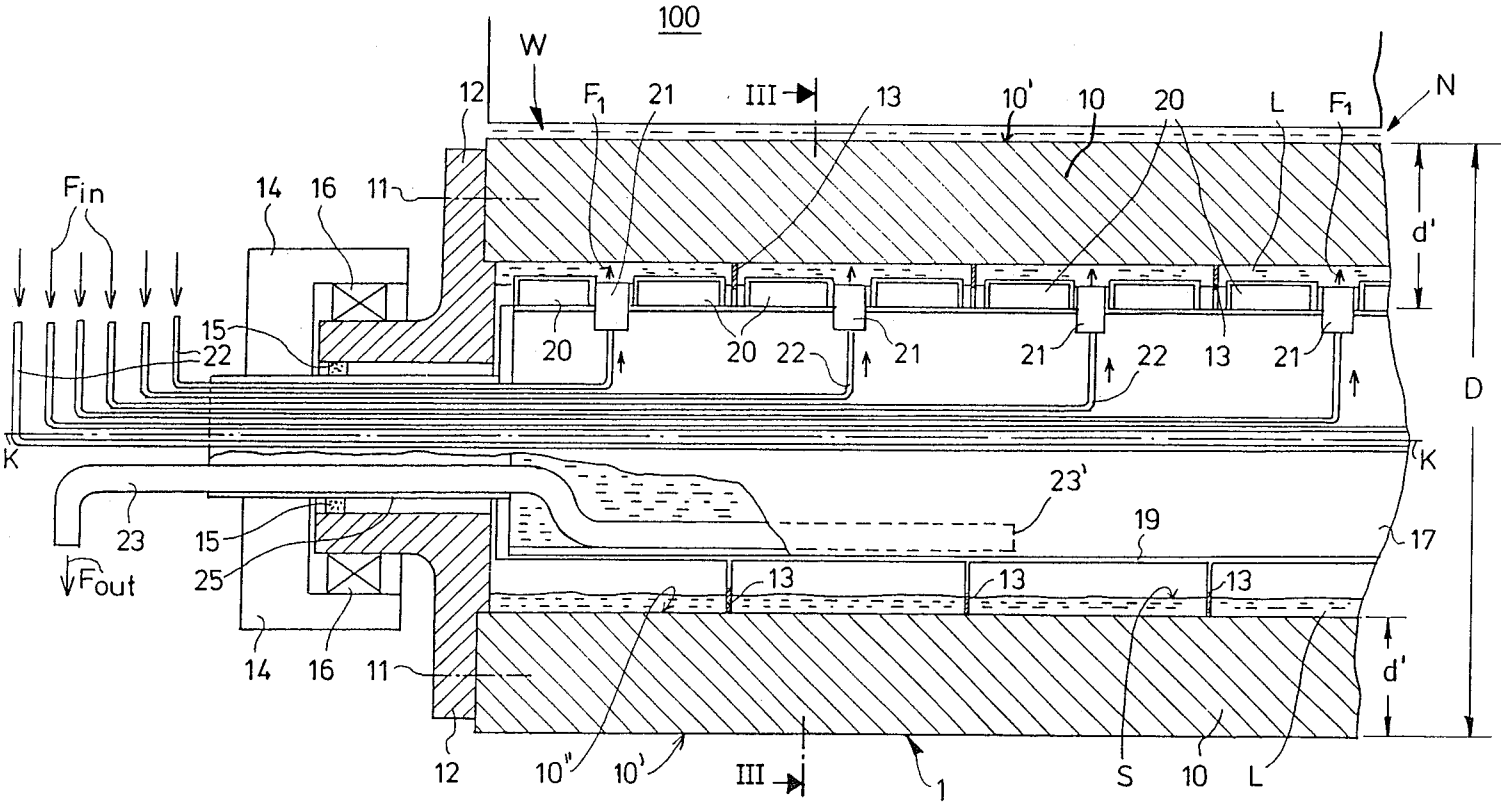
FIG. 1 is a partial axial section view of a roll in accordance with one embodiment of the present invention.

Referring now to the drawings wherein like reference characters designate identical or corresponding parts throughout the several views, and more particularly to FIG. 1, a heated calender roll used in the manufacture of paper is illustrated in which the temperature level, and possibly also the temperature profile in the axial direction K-K of the roll, of the smooth outer surface 10' of the roll mantle 10 are controlled by means in accordance with the method and apparatus of the invention. More specifically, a nip N formed by two rolls 1 and 100, e.g. a calendering nip, is illustrated in FIG. 1, with a running paper web W passing through the nip N formed by the two rolls 1 and 100.

The roll 1 comprises a cylindrical outer mantle 10 to the axial ends of which caps 12 are connected by means of screws 11. The caps 12 are mounted in bearing housings 14 by means of bearings 16 so that the roll is moutned for rotation. The roll is provided with a stationary inner shaft 17 whose ends 25 extend through the caps 12 and housing 14. Seals 15 are provided between the ends 25 of the inner shaft 17 and the inner surfaces of the annular portions of the caps 12. A tubular trough 19 is formed within the inner shaft 17 as best seen in FIG. 3.

Annular partition walls 13 are attached to the inner surface 10'' of the roll mantle 10 and are preferably uniformly spaced in the axial direction of the roll. The partition walls 13 divide the inner surface 10'' of mantle 10 in the axial direction into several sections situated in side-by-side fashion. The partition walls 13 are supported and fixed in their respective positions by axially extending ribs 24 (FIG. 3) which are uniformly spaced along the inner surface 10'' of mantle 10. Four such ribs are illustrated in the preferred embodiment.

Figure 3:
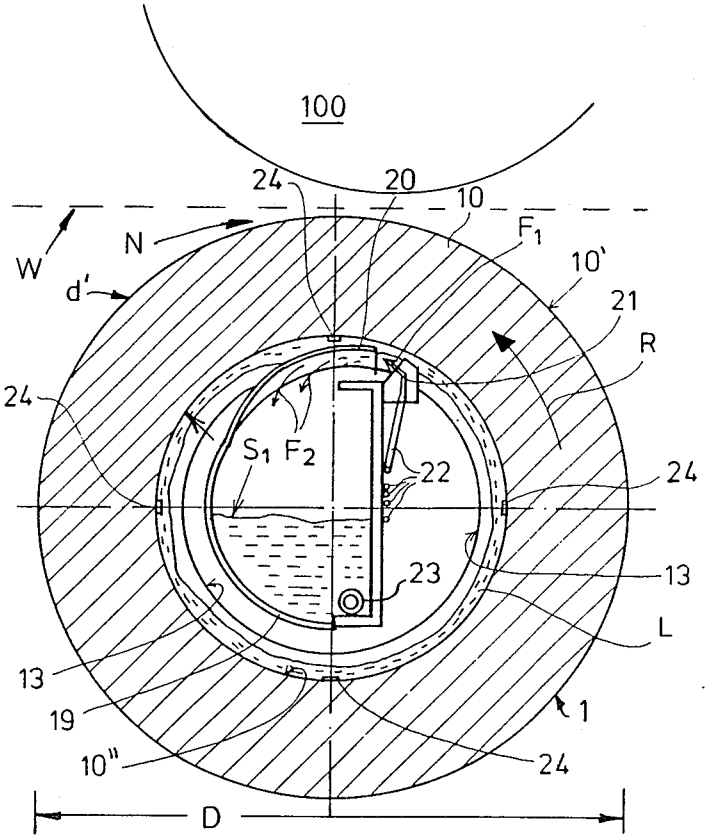
FIG. 3 is a section view taken along line III—III of FIG. 1.

Referring to FIGS. 1 and 3, an inlet pipe 22 adapted to carry heat transfer liquid is attached to the inner shaft 17 for each section defined by a pair of partition walls 13, each pipe 22 having a nozzle 21 provided at its inner end in a respective section. Thus, there is one inlet pipe 22 for each section separated by a pair of partition walls 13 and a single respective nozzle 21 is provided in each section. The discharge openings of the nozzles 21 are preferably in the form of slots which spread the flow of heat transfer liquid from the inlet pipes 22 in the axial direction of the roll. The nozzle 21 are directed in the direction of the circumference of the mantle 10 so that the component of the velocity of the liquid flowing from the nozzles 21 is parallel to the direction of rotation R (FIG. 3) of the roll.

The heat transfer liquid is discharged from the nozzles at a sufficiently high velocity so as to maintain the liquid on the inner surface 10'' of the mantle 10 under the effect of centrifugal force. Moreover, in each section defined between a pair of partition walls 13, a pair of stationary catchers 20 are attached to the inner shaft 17, each catcher 20 being situated on a respective axial side of a respective nozzle 21. The catchers 20 function to receive heat transfer liquid to be removed from the respective sections and guide the heat transfer liquid into the trough 19 within the inner shaft 17. Thus, upon discharge from the nozzles 21, the heat transfer liquid flows between the catchers 20 and around the circumference of the inner surface 10'' of mantle 10 of a respective section spreading laterally or axially as the liquid travels around the circumference. By the time the heat transfer liquid returns to the region of catchers 20, it has spread laterally to an extent such that the heat transfer liquid will be skimmed into the catchers to be received within the trough 19.

Still referring to FIGS. 1 and 3, the incoming heat transfer liquid discharged from a nozzle 21 into a particular respective annular section is designated $F_1$ and the heating liquid skimmed from the liquid layer L is designated $F_2$. The surface of the heating liquid within the trough 19 is designated $S_1$ and the surface of the liquid layer formed on the inner surface 10'' of mantle 10 is designated S.

The heat transfer liquid is removed from trough 19 through a suction pipe 23 which extends therethrough and having an entrance opening 23'. The inlet pipes 22 and the suction pipe 23 are preferably arranged so that the same number of inlet pipes 22 pass into the roll at each end 12 of mantle 10 of the roll and so that a single suction pipe 23 passes into the inner shaft 17 at each end of the roll. The inflows of the heating liquid into pipes 22 are designated in FIG. 1 as $F_{in}$ while the outflow of heat transfer liquid is designated as $F_{out}$.

By suitably adjusting the temperature of the heat transfer liquid $F_{in}$ prior to entry into the inlet pipes 22, as described in greater detail below, temperature level L in each of the sections separated by the partition walls 13 and the axial temperature profile of the mantle 10 can be controlled with great precision. More particularly, the temperature level L in each of the sections determines the degree of the thermal expansion of the roll mantle 10 adjacent the respective section, thereby determining the particular size of the diameter d' of the mantle 10, i.e. the diameter D of the entire roll 1 at this particular location. This altered diameter D of the roll, over the axial length K-K of the same, influences the pressure applied in the nip N, i.e. by roll 1 against counter-roll 100, over the axial direction. The transverse thickness profile of the paper web W passing through the nip N will be controlled, based upon the applied axial K-K pressure profile.

By virtue of the manner in which the heat transfer liquid is discharged from nozzles 21 to form a layer of heat transfer liquid around the circumference of each annular section on the inner surface 10" of mantle 10, an extremely good heat exchange relationship is provided between the inner surface 10" of the roll mantle 10 and the heat transfer liquid.

Figure 2:
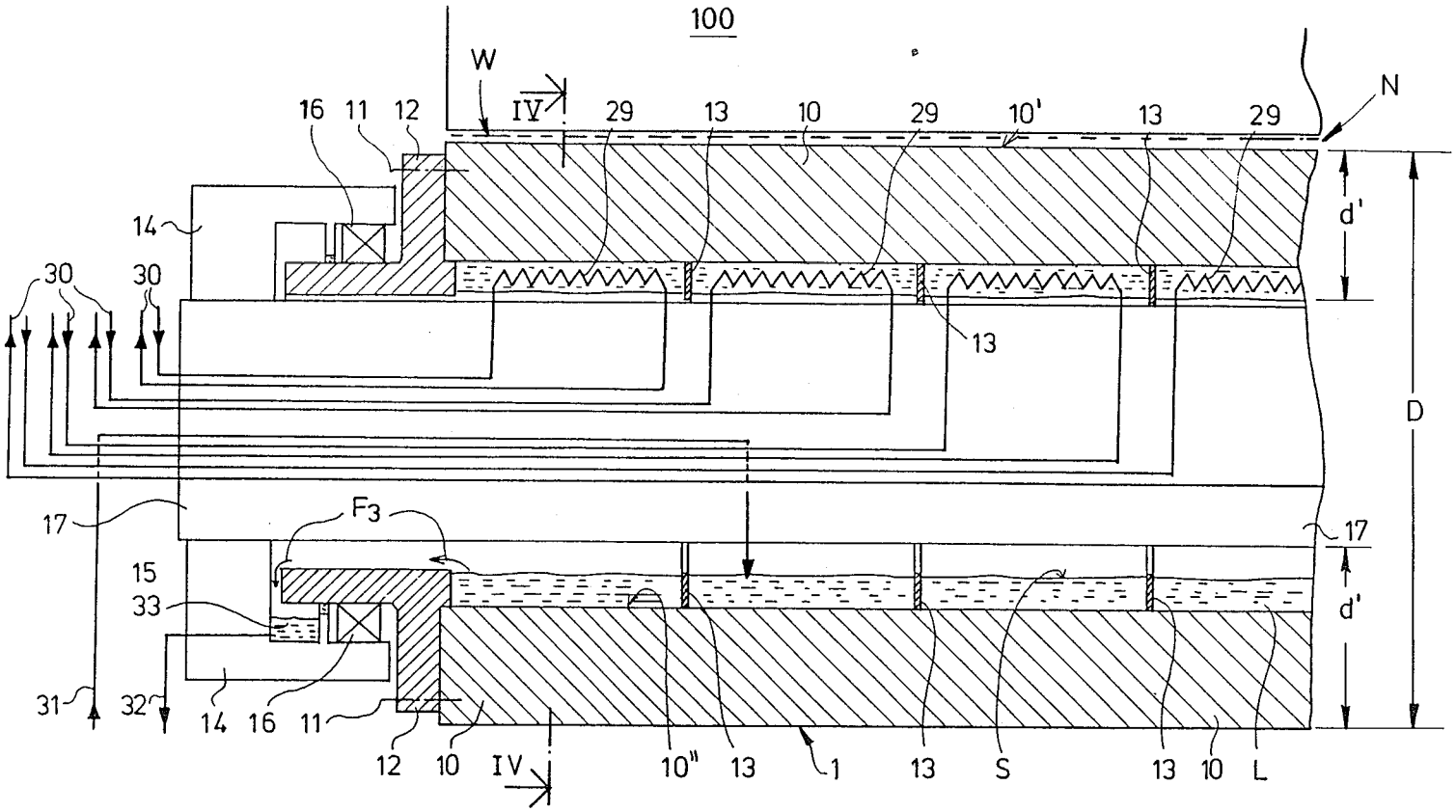
FIG. 2 is a partial axial section view of a roll in accordance with a second embodiment of the present invention.
Figure 4:
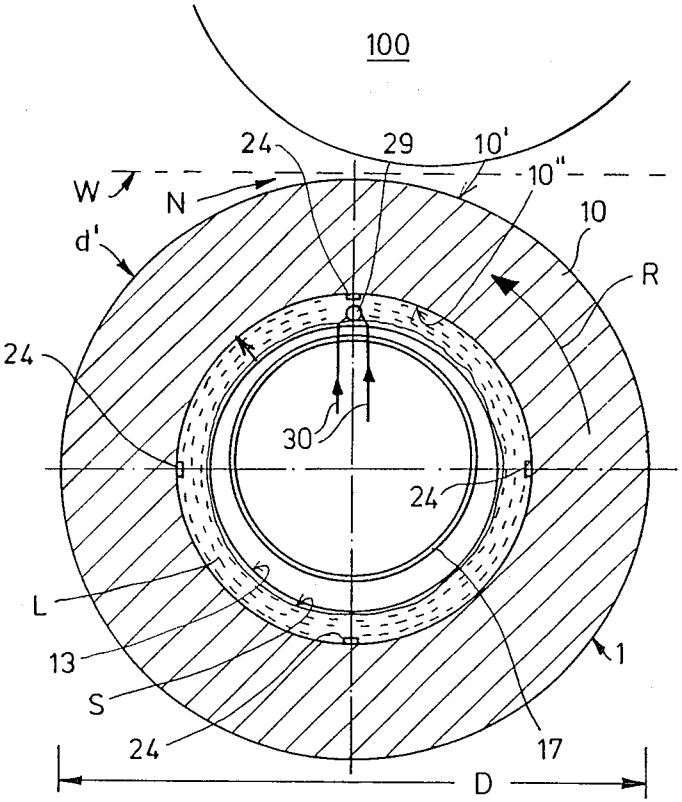
FIG. 4 is a section view taken along line IV—IV of FIG. 2.

Referring now to FIGS. 2 and 4, a second embodiment of the invention is illustrated (similar components are denoted by the same reference numerals). As in the case of the embodiment of FIGS. 1 and 3, the space between the stationary shaft 17 and the inner surface 10" of the roll mantle 10 is divided into a plurality of annular sections by means of annular partition walls 13, each of the sections containing a layer L of heat transfer liquid in heat exchange relationship with the inner surface 10" of mantle 10. However, instead of controlling the temperature of the heat exchange liquid layer in each section by means of separate circulation systems as in the case of the previously described embodiment, the temperature of the heat transfer liquid layer in each section is controlled by means of separate heating and/or cooling elements 29 provided in each section. The heat exchange elements 29 may comprise either electric resistors or spiral heat exchange tubes or groups of such tubes through which heating/cooling liquid flows. The illustration in FIG. 2 can represent either such alternative.

In the case where the elements 29 comprise electric resistors, each resistor 39 is connected by means of electric conductors 30 to a DC or AC current source so that the heating power in each section can be individually adjusted. In the case there the elements 29 comprise heat exchange tubes, heating/cooling liquid is circulated through the spiral tubes through inlet and outlet conduits 30.

Since the temperature of the heat transfer liquid layers in the embodiment of FIGS. 2 and 4 is not controlled by means of circulation of the heat transfer liquid, catchers 20 are not required. Rather, the liquid layer L functions solely as a heat transfer medium. However, it is preferable to provide a common slight circulation flow through all of the sections in order to assure that all of the sections have a constant quantity of heat transfer liquid at all times. In the illustrated embodiments an inlet pipe 31 is passed through each end of the roll symmetrically into the two middle sections and a slight flow of heat transfer liquid is maintained through pipe 31. In this manner, a slight liquid flow occurs over the inner edges of the partition walls 13 towards the ends 12 of the roll. The circulating heat transfer liquid $F_3$ thus flows through adjoining sections and into a space 33 at each end of the roll from where it is discharged through an outlet pipe 32. The circulation of heat transfer liquid as described above is so slight that it has substantially no effect on the temperature prevailing in the various sections.

The thickness profile of a paper web W passing through the nip N between rolls 1 and 100 in the embodiment of FIGS. 2 and 4, is controlled in a similar manner to the embodiment of FIGS. 1 and 3. In other words, the temperature level L in each of the sections also determines the degree of thermal expansion of the roll mantle 10 immediately adjacent thereto, thereby varying diameter D of the roll 1 at the respective locations, and the pressure applied against the running paper web through the nip N over the axial direction. The transverse thickness profile of the paper web is thereby controlled.

Figure 5:
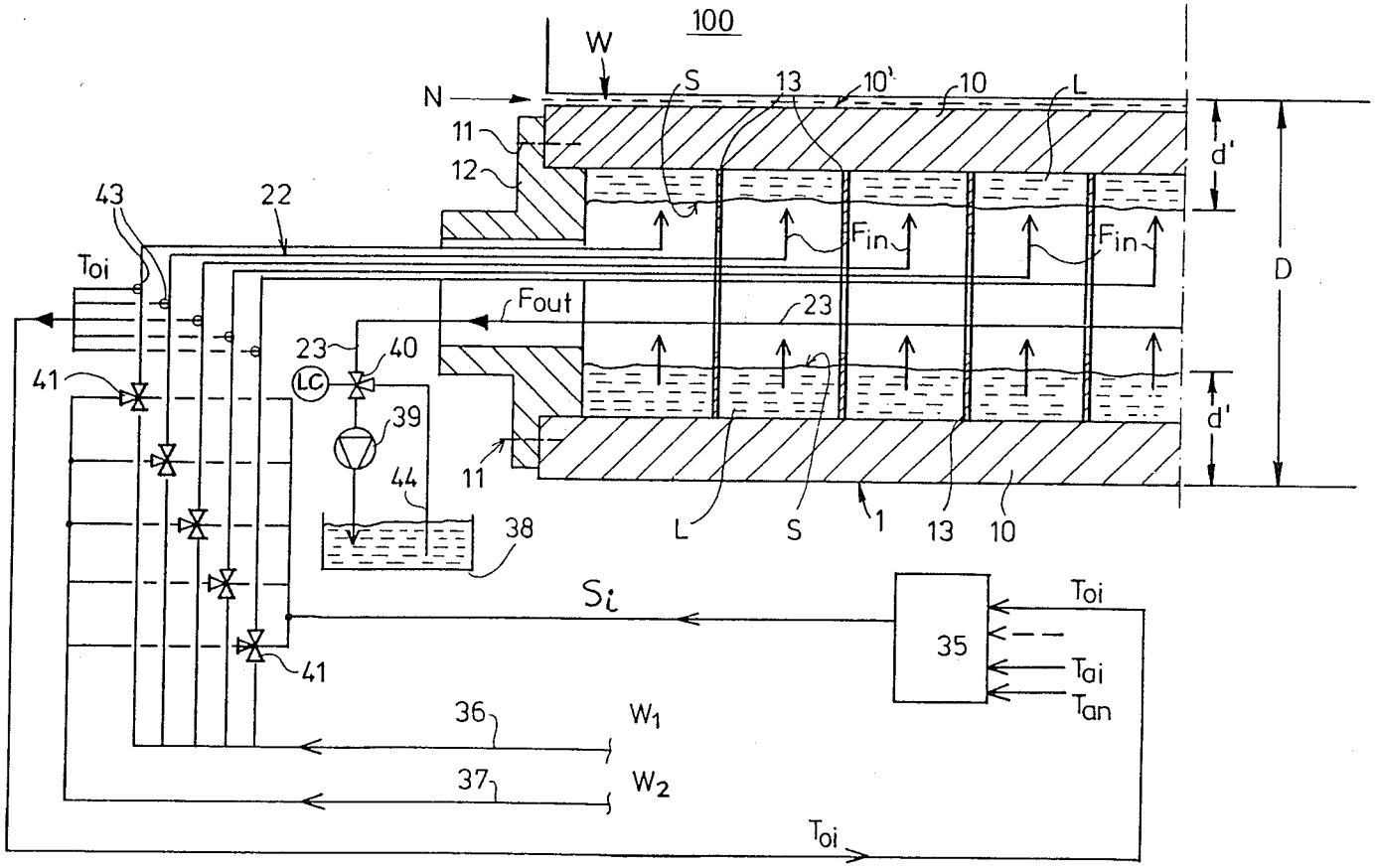
FIG. 5 is a schematic illustration of a control system for use in connection with the method and apparatus of the invention and by means of which the axial temperature profile of the roll mantle can be adjusted.

When the method of the invention is used for the adjustment of the axial temperature profile of the roll mantle, i.e. adjustment of the expansion and/or contraction of the mantle 10 diameter d', thereby determining pressure profile in the nip N and providing for adjustment of the thickness profile of the paper for calibration, the temperature of the heat transfer liquid flowing into the respective sections separated by the partition walls 13 can be adjusted and a control system for accomplishing such adjustment is shown in FIG. 5. Preset temperature values $T_{ai}$ (i=1 . . . n, wherein n is the number of sections) are programmed into the control unit 35, $T_{ai}$ representing the desired value of the temperature of the heat transfer liquid in the i th section. The control unit functions to adjust the actual temperatures $T_{oi}$ of the heat transfer liquid so as to be equal to the preset values $T_{ai}$. The control unit 35 generates control signals $S_i$ which are proportional to the differences between the actual and preset temperature values $T_{oi}$ and $T_{ai}$. The signals $S_i$ control the corresponding three-way valves 41 into which warm water $W_1$ and cold water $W_2$ are passed through respective pipes 36 and 37.

The warm and cold water $W_1$ and $W_2$ are mixed in the three-way valves 41 in a conventional manner in such a proportion that the actual values $T_{oi}$ are adjusted to be equal to the preset values $T_{ai}$ for the flows $F_{in}$ of heat transfer liquid supplied into the roll. The actual values $T_{oi}$ of the temperatures of the flows $F_{in}$ are measured by temperature detectors 43 provided in pipes 22. The outlet water flow $F_{out}$ is passed from the roll in the manner described above through a common pipe 23 by means of a suction pump 39 whose pressure side is connected to the outlet liquid tank 38. A three-way valve 40 is provided in outlet pipe 23 to which a side flow pipe 44 is connected from a tank 38. By means of a control motor LC associated with valve 40, the flow $F_{out}$ can be adjusted in a conventional manner.

Control and adjustment of the axial temperature profile and thereby expansion and/or contraction of the roll mantle 10 diameter d' in accordance with the invention as described above is advantageous with respect to conventional prior art arrangements which have been based on cooling of the outer roll surface by blowing air onto the external surface of the roll in that the heat transfer factor from the heat transfer liquid L to the roll mantle 10 is considerably higher than from air to the mantle. The invention is also well suited for use in the adjustment of the thickness profile of a paper or board web when a roll in a hot calender is heated externally. Moreover, counter roll 100 may also be provided with means for controlling temperature of liquid supplied thereto, as roll 1.

It is understood that when the invention is used in heating a roll uniformly in its axial direction without necessity of adjusting the axial temperature profile of the roll, there is no requirement for a control circuit of the type illustrated in FIG. 5 and separate inflow pipes 22 are not required, the heat transfer liquid being supplied to the annular sections from a common pipe with separate branches Obviously, numerous modifications and variations of the present invention are possible in the light of the above teachings. It is therefore to be understood that within the scope of the claims appended hereto, the invention may be practiced otherwise than as specifically described herein.

I claim:

1. A method for controlling the thickness profile of a web passing through a nip formed between two rolls, one of the rolls including a stationary shaft having an outer surface and a rotatable hollow mantle having an inner surface spaced from the outer surface of the shaft and an outer surface comprising the roll surface, comprising the steps of:

forming a plurality of separate axially adjacent heat transfer liquid layers within said roll mantle in heat transfer relationship with corresponding axial sections of the inner surface of said roll mantle and spaced from the outer surface of the shaft;

providing means for controlling the temperature of the heat transfer liquid of each heat transfer liquid layer;

controlling the temperature of the heat transfer liquid of each heat transfer liquid layer in accordance with a desired thickness profile of the web, such that the diameters of axial regions of the roll mantle corresponding to the axial inner surface sections which are in heat transfer relationship with the heat transfer liquid sections expand or contract by thermal expansion or contraction;

the extent of expansion or contraction of the diameter of each axial roll mantle region determined by the temperature of the heat transfer liquid section corresponding thereto.

2. The method of claim 1, wherein the extent of the expansion or contraction of the diameter of each axial roll mantle region determines pressure applied over a corresponding region of the nip formed by the roll.

3. The method of claim 1 wherein the temperature controlling step includes controlling the temperature of each heat transfer liquid layer independently of the temperature of other heat transfer liquid layers.

4. The method of claim 1, comprising the additional step of maintaining the liquid on the inner surface of the mantle, under the effect of centrifugal force.

5. The method of claim 1, wherein the liquid functions solely as a heat transfer medium.

6. The method of claim 1, wherein said separate liquid layers are formed by disposing partition means for dividing a liquid layer ionto said separate layers on said inner surface of said mantle.

7. The method of claim 6, wherein said partition means comprise a plurality of substantially annular partition walls connected to said mantle inner surface at mutually spaced locations and extending substantially entirely therearound.

8. The method of claim 1 wherein the temperature controlling step includes separately circulating the heat transfer liquid of each respective layer b withdrawing the heat transfer liquid of the layer from the roll, adjusting the temperature of the heat transfer liquid and passing the heat transfer liquid back to the layer.

9. The method of claim 8 wherein said heat transfer liquid of each layer is withdrawn by a stationary catcher situated in that respective section.

10. The method of claim 8 wherein the temperature of the heat transfer liquid is adjusted by mixing at least two liquids at different temperatures to obtain a liquid having a desired adjusted temperature.

11. The method of claim 1, comprising the additional step of forming the layers of heat transfer liquid on the inner surface of the mantle during rotation thereof by effect of centrifugal forces generated during the rotation of the mantle so that the layers of heat transfer liquid have thicknesses, and separating adjacent heat transfer liquid layers from each other by partition walls affixed to the inner surface of the roll mantle, each partition wall having a height greater than the thickness of the adjacent layers of heat transfer liquid which it separates.

12. The method of claim 11, wherein the temperature controlling step includes directing the liquid into each said section in a direction substantially parallel to direction of rotation of the roll.

13. The method of claim 11wherein the temperature controlling step includes separately adjusting the temperature of heat transfer liquid of each of said heat transfer liquid layers by stationary heating means situated in said respective heat transfer liquid layers.

14. The method of claim 13 further including the step of maintaining the thickness of the heat transfer liquid layers substantially constant.

15. The method of claim 14 wherein the thickness of the heat transfer liquid layers of respective sections is maintained substantially constant by circulating the heat transfer liquid of the layers to an extent substantially not affecting heat transferred by the heat transfer liquid.

16. The method of claim 15 wherein the heat transfer liquid of the layers is circulated by introducing heat transfer liquid into at least one layer situated between other layers and collecting heat transfer liquid at axial ends of the roll.

17. A roll for use in controlling the thickness profile of a paper web passing through a calendering nip formed by said roll and a counter-roll, comprising a cylindrical outer mantle rotatably mounted at its axial ends, said mantle having inner and outer surfaces;

a stationary shaft situated within said mantle;

means for forming a layer of heat transfer liquid on said inner surface of said mantle;

partition means connected to said inner surface of said mantle for dividing said liquid layer into a plurality of separate annular sections in the axial direction of said roll mantle, said sections of heat transfer liquid being in heat transfer relationship with corresponding axial regions of said roll mantle;

means for controlling the temperature of the heat transfer liquid layer of each of said sections;

the diameter of each of said axial roll mantle regions being thermally expandable or contractable based upon heat transferred between each heat transfer liquid section and corresponding roll mantle region, whereby pressure applied in said nip is adjustable over the axial direction thereof, based upon changes in said roll diameter effected by said temperature controlling means, and the thickness profile of the web passing through the nip being thus controlled by the axial pressure profile applied in the nip.

18. The combination of claim 17, wherein said partition means extend substantially entirely around said inner surface of said roll mantle.

19. The combination of claim 17, wherein said temperature controlling means constitute means for controlling temperature of the heat transfer liquid layer of each section independently from any other section.

20. The combination of claim 17 wherein said annular sections are of substantially equal axial dimension.

21. The combination of claim 17, additionally comprising means for maintaining the liquid on said inner surface of said mantle under effect of centrifugal force.

22. The combination of claim 17, wherein the diameter of each of said axial roll mantle region is adjustable solely by the heat transferred.

23. The combination of claim 17, wherein said forming means constitute means for forming said heat transfer liquid layer under the effect of centrifugal force generated during rotation of said mantle.

24. The combination of claim 23, wherein said temperature controlling means comprise a nozzle in each said section for introducing the liquid into respective section, each said nozzle oriented to direct the liquid into said respective section substantially parallel to the direction of rotation of the roll.

25. The combination of claim 17 wherein said partition means include a plurality of substantially annular partition walls connected to said mantle inner surface at mutually spaced locations.

26. The combination of claim 25, wherein there is a gap between an inner end of each said partition wall and an outer surface of said stationary shaft.

27. The combination of claim 25, wherein each said partition wall extends substantially entirely around said mantle inner surface.

28. The combination of claim 17 wherein said means for controlling the temperature of the heat transfer liquid layer of each of said sections includes stationary liquid heating means situated in respective sections.

29. The combination of claim 28 wherein said stationary liquid heating means comprise electric resistor elements fixed to said stationary inner shaft coupled to an external source of electricity.

30. The combination of claim 28 wherein said stationary liquid heating means comprise a heat exchange fluid conduit fixed to said stationary inner shaft coupled to a source of circulating heat exchange fluid.

31. The combination of claim 28 further including means for introducing small quantities of circulating heat transfer liquid into at least one annular section situated between other sections, heat transfer liquid collecting means situated at axial ends of the roll and means for withdrawing the small quantities of the circulated heat transfer liquid collected at said collecting means.

32. The combination of claim 17 wherein said means for controlling the temperature of the heat transfer liquid layer of each of said sections include respective means provided at each of said sections for withdrawing heat transfer liquid from the heat transfer layer of said respective sections, means for adjusting the temperature of the withdrawn heat transfer liquid, and respective nozzle means provided at each of said sections for introducing the adjusted temperature heat transfer liquid into the heat transfer liquid layer of said respective sections.

33. The combination of claim 32 wherein said means for adjusting the temperature of the withdrawn heat transfer liquid include control system means for mixing at least two liquids at different temperatures to obtain a liquid having a desired adjusted temperature.

34. The combination of claim 32 wherein for each respective section said nozzle means include a nozzle situated at a substantially axially central location of the respective section, and said liquid withdrawing means include at least one stationary catcher situated at said respective section, and liquid conduit means fluidly coupled to said catcher for passing heat transfer liquid to the outside of said roll.

35. The combination of claim 34, wherein a pair of stationary catchers are situated at said respective sections, each catcher being situated on a respective side of said nozzle.

36. The combination of claim 34 wherein said liquid conduit means include discharge pipe means situated within a space provided within said stationary inner shaft.

37. The combination of claim 36 wherein a suction pump is connected to said discharge pipe means.

* * * * *